US008424508B2

(12) United States Patent
Adler et al.

(10) Patent No.: US 8,424,508 B2
(45) Date of Patent: Apr. 23, 2013

(54) FUEL PRESSURE REGULATING SYSTEM

(75) Inventors: Christoph Adler, Regensburg (DE); Uwe Jung, Wörth a. d. Donau (DE); Hui Li, Regensburg (DE); Michael Wirkowski, Regensburg (DE); Hong Zhang, Tegernheim (DE)

(73) Assignee: Continental Automotive GmbH, Hannover (DE)

( * ) Notice: Subject to any disclaimer, the term of this patent is extended or adjusted under 35 U.S.C. 154(b) by 402 days.

(21) Appl. No.: 12/747,919

(22) PCT Filed: Oct. 15, 2008

(86) PCT No.: PCT/EP2008/063864

§ 371 (c)(1),
(2), (4) Date: Jun. 13, 2010

(87) PCT Pub. No.: WO2009/074379

PCT Pub. Date: Jun. 18, 2009

(65) Prior Publication Data

US 2010/0258083 A1 Oct. 14, 2010

(30) Foreign Application Priority Data

Dec. 13, 2007 (DE) ..... 10 2007 060 006

(51) Int. Cl.
*F02M 59/20* (2006.01)
*F02M 59/36* (2006.01)

(52) U.S. Cl.
USPC ..... 123/458; 123/514

(58) Field of Classification Search ..... 123/456, 123/447, 457, 458, 460, 463, 469, 495, 506, 123/510, 511, 514
See application file for complete search history.

(56) References Cited

U.S. PATENT DOCUMENTS 4,359,032 A * 11/1982 Ohie ..... 123/458
6,119,655 A * 9/2000 Heinitz et al. ..... 123/447
(Continued)

FOREIGN PATENT DOCUMENTS

DE 3825138 4/1989
DE 19548278 6/1997
(Continued)

OTHER PUBLICATIONS

German Office Action for Application No. 10 2007 060 006.4 (4 pages), Jul. 16, 2008.

(Continued)

*Primary Examiner* — Mahmoud Gimie
(74) *Attorney, Agent, or Firm* — King & Spalding L.L.P.

(57) ABSTRACT

A fuel pressure regulating system for an internal combustion engine has a pressure accumulator which is used to store fuel under pressure and to feed the combustion chambers of the internal combustion engine by fuel-supplying injectors, a high-pressure pump which supplies a fuel mass flux to the pressure accumulator, a first valve via which the fuel can be guided out of the pressure accumulator, and a second valve for restricting the fuel mass flux. The system is provided with a first control loop having the first valve as an actuator for regulating the pressure in the pressure accumulator, and a second control loop having the second valve as an actuator for regulating the pressure in the pressure accumulator, and the two control loops are embodied as cascade regulators, the first control loop being a master regulator and the second control loop being a follower regulator.

15 Claims, 2 Drawing Sheets

U.S. PATENT DOCUMENTS

| | | | | |
|---|---|---|---|---|
| 6,142,120 | A | 11/2000 | Biester et al. | 123/456 |
| 6,293,253 | B1 | 9/2001 | Arnold et al. | 123/458 |
| 6,578,553 | B1 | 6/2003 | Schubert et al. | 123/458 |
| 6,912,983 | B2 * | 7/2005 | Okamoto et al. | 123/179.16 |
| 7,302,935 | B2 | 12/2007 | Achleitner et al. | 123/446 |
| 2008/0257314 | A1 * | 10/2008 | Veit et al. | 123/511 |

FOREIGN PATENT DOCUMENTS

| | | |
|---|---|---|
| DE | 19612412 | 10/1997 |
| DE | 19802583 | 8/1999 |
| DE | 19844744 | 4/2000 |
| DE | 19916100 | 10/2000 |
| DE | 10323874 | 12/2004 |
| DE | 102006018164 | 8/2007 |
| FR | 2914699 | 10/2008 |

OTHER PUBLICATIONS

International Search Report for Application No. PCT/EP2008/063864 (7 pages), Feb. 24, 2009.

* cited by examiner

FUEL PRESSURE REGULATING SYSTEM

CROSS-REFERENCE TO RELATED APPLICATIONS

This application is a U.S. National Stage Application of International Application No. PCT/EP2008/063864 filed Oct. 15, 2008, which designates the United States of America, and claims priority to German Application No. 10 2007 060 006.4 filed Dec. 13, 2007, the contents of which are hereby incorporated by reference in their entirety.

TECHNICAL FIELD

The present invention relates to a fuel pressure regulating system for an internal combustion engine, said system comprising a pressure accumulator which stores fuel under pressure and feeds injectors supplying combustion chambers of the internal combustion engine with fuel, a high-pressure pump which supplies a fuel mass flow to the pressure accumulator, a first valve via which fuel can be discharged from the pressure accumulator, and a second valve for throttling the fuel mass flow.

BACKGROUND

In a fuel pressure regulating system of said kind, which is often used in common-rail injection systems, very high demands are imposed on the precision and the efficiency of the regulation of the pressure in the pressure accumulator. Fast and precise regulation is achieved through the use of the first valve as a final control element in the closed-loop control circuit. It is disadvantageous in this case that a requirement-oriented delivery of the fuel can then no longer be implemented, resulting in corresponding dissipation losses that lead to an undesirable excess consumption of the internal combustion engine.

In order to reduce the dissipation losses the regulating system having the first valve as a final control element can be replaced by a slower regulating system having the second valve as a final control element. This, however, disadvantageously leads to a slower and consequently less precise regulation.

SUMMARY

Proceeding on this basis, according to various embodiments a fuel pressure regulating system of the type cited in the introduction can be developed in such a way that a fast and precise regulation of the pressure in the pressure accumulator is possible simultaneously with extremely low dissipation losses.

According to an embodiment, a fuel pressure regulating system for an internal combustion engine, may comprise a pressure accumulator which stores fuel under pressure and feeds injectors providing combustion chambers of the internal combustion engine with fuel, a high-pressure pump which supplies a fuel mass flow to the pressure accumulator, a first valve via which fuel can be discharged from the pressure accumulator, and a second valve for throttling the fuel mass flow, a first closed-loop control circuit having the first valve as a final control element for regulating the pressure in the pressure accumulator, and a second closed-loop control circuit having the second valve as a final control element for regulating the pressure in the pressure accumulator, wherein the two closed-loop control circuits are embodied as a cascade controller having the first closed-loop control circuit as the master controller and the second closed-loop control circuit as a slave controller.

According to a further embodiment, a precontrol value can be specified for the slave controller, said precontrol value being selected such that the fuel mass flow which is determined by the slave controller is sufficient to enable a pressure to be attained in the pressure accumulator that is greater than the setpoint pressure. According to a further embodiment, the precontrol value can be adjusted by the slave controller. According to a further embodiment, the slave controller can be designed in such a way that the correction speed is different in magnitude as a function of the direction of the deviation from the setpoint pressure. According to a further embodiment, if the pressure in the pressure accumulator is less than the setpoint pressure, the correction speed of the slave controller can be greater than if the pressure in the pressure accumulator is greater or equal to the setpoint pressure.

According to another embodiment, a fuel pressure regulating method for an internal combustion engine may comprise a pressure accumulator which stores fuel under pressure and feeds injectors supplying combustion chambers of the internal combustion engine with fuel, a high-pressure pump which supplies a fuel mass flow to the pressure accumulator, a first valve via which fuel can be discharged from the pressure accumulator, and a second valve for throttling the fuel mass flow, wherein a first closed-loop control circuit having the first valve as a final control element for regulating the pressure in the pressure accumulator and a second closed-loop control circuit having the second valve as a final control element for regulating the pressure in the pressure accumulator are provided, and wherein the two closed-loop control circuits are embodied as a cascade controller having the first closed-loop control circuit as the master controller and the second closed-loop control circuit as a slave controller.

According to a further embodiment of the method, a precontrol value can be specified for the slave controller, said precontrol value being selected such that the fuel mass flow which is determined by the slave controller is sufficient to enable a pressure to be attained in the pressure accumulator that is greater than the setpoint pressure. According to a further embodiment of the method, the precontrol value can be adjusted by the slave controller. According to a further embodiment of the method, the slave controller can be designed in such a way that the correction speed is different in magnitude as a function of the direction of the deviation from the setpoint pressure. According to a further embodiment of the method, if the pressure in the pressure accumulator is less than the setpoint pressure, the correction speed of the slave controller can be greater than if the pressure in the pressure accumulator is greater or equal to the setpoint pressure.

BRIEF DESCRIPTION OF THE DRAWINGS

The invention is explained in more detail below by way of example with reference to the attached drawings which also disclose features essential to the invention and in which.

DETAILED DESCRIPTION

Figure 1:
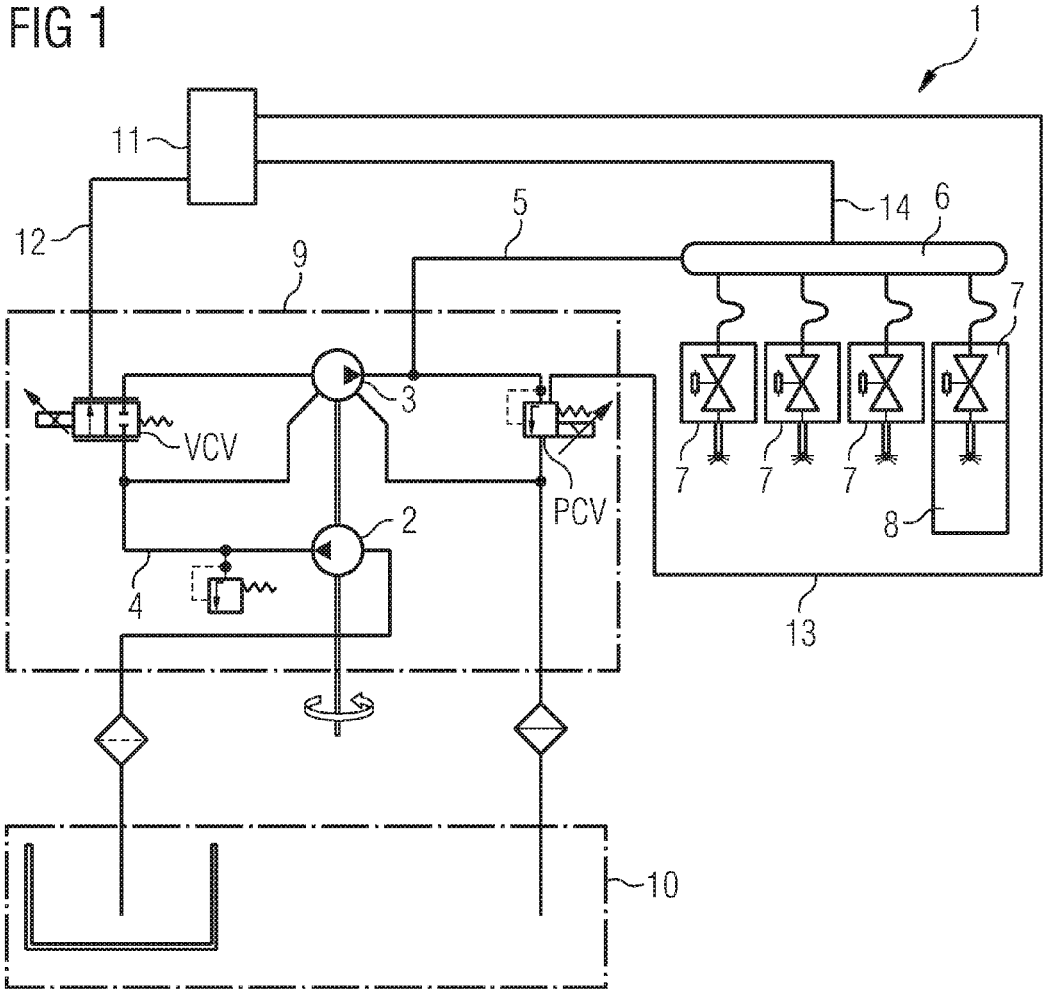
FIG. 1 shows a schematic view of a fuel pressure regulating system according to one embodiment.

According to various embodiments, a first closed-loop control circuit having the first valve as a final control element for regulating the pressure in the pressure accumulator and a second closed-loop control circuit having the second valve as a final control element for regulating the pressure in the pressure accumulator are provided, wherein the two closed-loop control circuits are embodied as a cascade controller having the first closed-loop control circuit as the master controller and having the second closed-loop control circuit as a slave controller.

The desired requirement-oriented regulation of the fuel mass flow is realized by means of the slave controller, as a result of which the undesirable dissipation losses are minimized. At the same time the fast and precise regulation of the pressure in the pressure accumulator is maintained owing to the master controller which effects the actual pressure regulation function.

In the fuel pressure regulating system according to various embodiments a precontrol value can be specified for the slave controller, said precontrol value being selected such that the fuel mass flow which is determined by the slave controller and which is supplied to the pressure accumulator is sufficient to ensure a pressure in the pressure accumulator that is greater than the setpoint pressure. In this way an undersupply of fuel to an injection system in which the fuel pressure regulating system according to various embodiments is used is avoided.

The precontrol value can be adjusted by the slave controller in such a way that the desired requirement-oriented fuel delivery can be ensured.

The slave controller can be embodied in particular in such a way that the correction speed is different in magnitude as a function of the direction of the deviation from the setpoint pressure. If the pressure in the pressure accumulator falls below the setpoint value, a fast response is desired.

The correction speed of the slave controller is therefore set preferably such that it is greater for the situation in which the pressure in the pressure accumulator is less than the setpoint pressure than for the situation in which the pressure in the pressure accumulator is greater than or equal to the setpoint pressure.

The fuel pressure regulating system according to various embodiments can be developed as a fuel injection system, in particular as a common-rail injection system. Furthermore the fuel pressure regulating system according to various embodiments can be used, for example, for diesel internal combustion engines. The diesel internal combustion engines can be in particular engines for passenger cars or freight vehicles.

In this case the pressure in the pressure accumulator can amount to as much as 1800 bar and can be regulated in the range from 200-2000 bar.

The internal combustion engine can be a gasoline internal combustion engine, in particular for passenger cars or freight vehicles. In this case the pressure in the pressure accumulator is usually significantly lower and tends to lie in the range from 200-600 bar.

Furthermore, owing to the use of the fuel pressure regulating system in an internal combustion engine, an internal combustion engine having the fuel pressure regulating system according to various embodiments is made available.

Also provided is a fuel pressure regulating method for an internal combustion engine, said method comprising a pressure accumulator which stores fuel under pressure and feeds injectors providing combustion chambers of the internal combustion engine with fuel, a high-pressure pump which supplies a fuel mass flow to the pressure accumulator, a first valve via which fuel can be discharged from the pressure accumulator, and a second valve for throttling the fuel mass flow, wherein a first closed-loop control circuit having the first valve as a final control element for regulating the pressure in the pressure accumulator and a second closed-loop control circuit having the second valve as a final control element for regulating the pressure in the pressure accumulator are provided such that the two closed-loop control circuits form a cascade controller having the first closed-loop control circuit as the master controller and the second closed-loop control circuit as a slave controller.

By means of a fuel pressure regulating method of said type it is possible to implement a requirement-oriented delivery of the fuel while at the same time providing a fast and precise regulation of the pressure in the pressure accumulator.

In the fuel pressure regulating method according to various embodiments a precontrol value can be specified for the slave controller, said precontrol value being selected such that the fuel mass flow determined by the slave controller is sufficient to achieve a pressure greater than the setpoint pressure in the pressure accumulator. In this way an undersupply of fuel to the pressure accumulator, and hence to an injection system in which the fuel pressure regulating system according to various embodiments is employed, is avoided.

The slave controller can adjust the precontrol value in order to achieve an optimally requirement-oriented fuel delivery.

The slave controller can furthermore be designed in such a way that the correction speed is different in magnitude as a function of the direction of the deviation from the setpoint pressure. Thus, the correction speed can in particular be greater for the situation in which the pressure in the pressure accumulator becomes less than the setpoint pressure than for the situation in which the pressure in the pressure accumulator becomes greater or equal to the setpoint pressure.

It is to be understood that the above-cited features and the features that are still to be explained in the following can be used not only in the disclosed combinations, but also in other combinations or in isolation, without leaving the scope of the present invention.

In the case of the embodiment variant shown in FIG. 1, the fuel pressure regulating system 1 according to various embodiments comprises a fuel prefeed pump 2 and a main pressure pump 3 which are connected to each other via a line 4. A mass flow valve VCV is arranged in the line 4.

The outlet of the main pressure pump 3 (i.e. the high-pressure side) is connected via a line 5 to a pressure accumulator 6 of an internal combustion engine. The pressure accumulator 6 is in turn connected to four injectors 7 which serve to feed the combustion chambers 8 (of which only one is shown in FIG. 1 in order to simplify the drawing) with fuel under high pressure (the pressure in the pressure accumulator 6). Accordingly the fuel pressure regulating system 1 is embodied as a fuel injection system.

The two pumps 2 and 3 form a high-pressure pump 9 which delivers the fuel from a tank 10 into the pressure accumulator 6 such that a predetermined pressure is present there.

The fuel pressure regulating system 1 also has a pressure limiting valve PCV which connects the outlet side of the main pressure pump 3 to the tank 10 and as a result can reduce the pressure in the pressure accumulator 6.

In addition the fuel pressure regulating system 1 includes a control unit 11 which actuates the two valves VCV and PCV (as indicated by means of the lines 12 and 13) and to which the actual pressure present in the pressure accumulator 6 is communicated, as indicated by means of the line 14.

A cascade controller 15 is implemented by means of the control unit 11 as well as the two valves VCV and PCV for the purpose of regulating the pressure of the fuel in the pressure accumulator 6.

Figure 2:
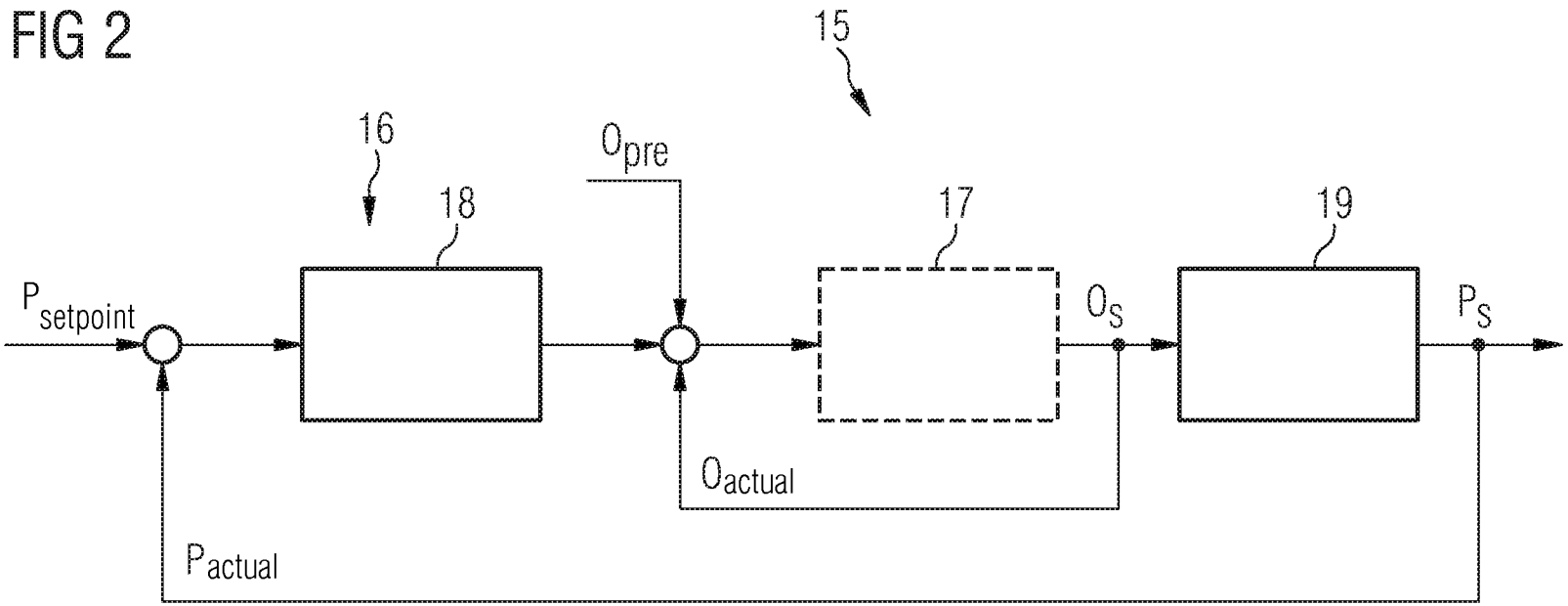
FIG. 2 shows a schematic representation intended to explain the cascade controller 15.

As can be seen most clearly from FIG. 2, the cascade controller 15 comprises a PCV master controller 16 (having the pressure limiting valve PCV as final control element) and a VCV slave controller 17 (having the mass flow valve VCV as final control element).

The actual pressure regulation for the pressure accumulator 6 is accomplished by means of the PCV master controller 16 which in the embodiment variant shown in FIG. 2 comprises a P controller 18 and an I controller 19. The VCV slave controller 17 is arranged relative to the PCV master controller 16 in such a way that it is possible to speak of a nesting of the VCV slave controller 17 in the PCV master controller 16.

In the case of the cascade controller 15 the position of the flow control valve VCV is preset by default as a function of the operating parameters of the internal combustion engine as well as of an individual characteristic curve adaption. In order to avoid the injection system being undersupplied with fuel the flow control valve VCV is opened by an additional offset $O_{pre}$.

Said offset $O_{pre}$ is adjusted by means of the VCV slave controller 17. The corresponding actuating signal for the valve VCV is identified as $O_S$ in FIG. 2. The actual offset is identified by $O_{actual}$.

Owing to the embodiment as a cascade controller 15, the PCV master controller 16 responds to a reduction in the fuel mass flow which is supplied to the pressure accumulator 6; owing to a corresponding actuation of the valve VCV by means of the VCV slave controller 17 (actuating signal $P_S$) the response entails a reduction in the fuel mass flow discharged from the pressure accumulator 6 into the tank 10 via the pressure limiting valve PCV.

If the fuel mass flow supplied via the flow control valve VCV is adjusted such that the offset is zero, a requirement-oriented fuel delivery is present. No more fuel is delivered than is required in the pressure accumulator 6. In this case a further reduction in the fuel mass flow discharged from the pressure accumulator 6 by means of the pressure limiting valve PCV no longer leads to a correction of the pressure in the pressure accumulator 6. Thus, if the pressure $P_{actual}$ in the pressure accumulator 6 becomes less than the setpoint value $P_{setpoint}$, the VCV slave controller 17 responds by opening the flow control valve VCV until the setpoint pressure is reached once again. The operation of the VCV slave controller 17 around this point leads to a fuel delivery that in overall terms is tailored to requirements.

The VCV slave controller 17 can be designed in particular in such a way that the correction speed is dependent on the direction of the deviation. While the pressure $P_{actual}$ in the pressure accumulator 6 is greater than or equal to the setpoint pressure $P_{setpoint}$, a slow regulation takes place by means of the VCV slave controller 17. If, however, the pressure in the pressure accumulator 6 falls below the setpoint value $P_{setpoint}$, a fast readjustment is performed by means of the VCV slave controller 17. In particular the control value $O_S$ for the flow control valve VCV can increase abruptly.

Thanks to the requirement-oriented regulation of the fuel mass flow into the pressure accumulator 6, undesirable dissipation losses are minimized and at the same time a high regulating precision is achieved by the PCV master controller 15.

The fuel pressure regulating system 1 can be used with diesel or gasoline engines.

What is claimed is:

1. A fuel pressure regulating system for an internal combustion engine, said system comprising:

a pressure accumulator which stores fuel under pressure and feeds injectors providing combustion chambers of the internal combustion engine with fuel, a high-pressure pump which supplies a fuel mass flow to the pressure accumulator, a first valve via which fuel can be discharged from the pressure accumulator, a second valve for throttling the fuel mass flow, a first closed-loop control circuit having the first valve as a final control element for regulating the pressure in the pressure accumulator, and a second closed-loop control circuit having the second valve as a final control element for regulating the pressure in the pressure accumulator, wherein the two closed-loop control circuits are embodied as a cascade controller having the first closed-loop control circuit as the master controller and the second closed-loop control circuit as a slave controller.

2. The fuel pressure regulating system according to claim 1, wherein a precontrol value is specified for the slave controller, said precontrol value being selected such that the fuel mass flow which is determined by the slave controller is sufficient to enable a pressure to be attained in the pressure accumulator that is greater than the setpoint pressure.

3. The fuel pressure regulating system according to claim 2, wherein the precontrol value is adjusted by the slave controller.

4. The fuel pressure regulating system according to claim 1, wherein the slave controller is designed in such a way that a correction speed is different in magnitude as a function of the direction of a deviation from the setpoint pressure.

5. The fuel pressure regulating system according to claim 4, wherein if the pressure in the pressure accumulator is less than the setpoint pressure, the correction speed of the slave controller is greater than if the pressure in the pressure accumulator is greater or equal to the setpoint pressure.

6. A fuel pressure regulating method for an internal combustion engine, wherein a pressure accumulator stores fuel under pressure and feeds injectors supplying combustion chambers of the internal combustion engine with fuel, the method comprising:

supplying a fuel mass flow to the pressure accumulator by a high-pressure pump, discharging fuel from the pressure accumulator by a first valve via, throttling the fuel mass flow by a second valve, regulating the pressure in the pressure accumulator by a first closed-loop control circuit having the first valve as a final control element, and regulating the pressure in the pressure accumulator by a second closed-loop control circuit having the second valve as a final control element, wherein the two closed-loop control circuits are embodied as a cascade controller having the first closed-loop control circuit as the master controller and the second closed-loop control circuit as a slave controller.

7. The fuel pressure regulating method according to claim 6, wherein a precontrol value is specified for the slave controller, said precontrol value being selected such that the fuel mass flow which is determined by the slave controller is sufficient to enable a pressure to be attained in the pressure accumulator that is greater than the setpoint pressure.

8. The fuel pressure regulating method according to claim 7, wherein the precontrol value is adjusted by the slave controller.

9. The fuel pressure regulating method according to claim 6, wherein the slave controller is designed in such a way that a correction speed is different in magnitude as a function of the direction of a deviation from the setpoint pressure.

10. The fuel pressure regulating method according to claim 9, wherein if the pressure in the pressure accumulator is less than the setpoint pressure, the correction speed of the slave controller is greater than if the pressure in the pressure accumulator is greater or equal to the setpoint pressure.

11. A vehicle comprising a fuel pressure regulating system comprising:

an internal combustion engine comprising fuel injectors;

a pressure accumulator storing fuel under pressure and feeding said fuel injectors, a high-pressure pump supplying a fuel mass flow to the pressure accumulator, a first closed-loop control circuit having a first valve as a final control element for regulating the pressure in the pressure accumulator, and a second closed-loop control circuit having a second valve as a final control element for regulating the pressure in the pressure accumulator, wherein the two closed-loop control circuits are embodied as a cascade controller having the first closed-loop control circuit as the master controller and the second closed-loop control circuit as a slave controller.

12. The vehicle according to claim 11, wherein a precontrol value is specified for the slave controller, said precontrol value being selected such that the fuel mass flow which is determined by the slave controller is sufficient to enable a pressure to be attained in the pressure accumulator that is greater than the setpoint pressure.

13. The vehicle according to claim 12, wherein the precontrol value is adjusted by the slave controller.

14. The vehicle according to claim 11, wherein the slave controller is designed in such a way that a correction speed is different in magnitude as a function of the direction of a deviation from the setpoint pressure.

15. The vehicle according to claim 14, wherein if the pressure in the pressure accumulator is less than the setpoint pressure, the correction speed of the slave controller is greater than if the pressure in the pressure accumulator is greater or equal to the setpoint pressure.

* * * * *